United States Patent [19]

Feldman

[11] 4,335,930

[45] Jun. 22, 1982

[54] TOOLLESS PHONE PLUG

[75] Inventor: Steven Feldman, Seminole, Fla.

[73] Assignee: AMP Incorporated, Harrisburg, Pa.

[21] Appl. No.: 159,901

[22] Filed: Jun. 16, 1980

[51] Int. Cl.[3] ..... H01R 17/18

[52] U.S. Cl. ..... 339/183

[58] Field of Search ..... 339/182 R, 183; 179/59, 179/62, 63

[56] References Cited

U.S. PATENT DOCUMENTS

| | | | |
|---|---|---|---|
| 381,430 | 4/1888 | Scribner | 179/95 |
| 3,289,149 | 11/1966 | Pawloski | 339/183 |
| 3,656,089 | 4/1972 | Bailey | 339/183 X |
| 4,018,501 | 4/1977 | Maloof | 339/183 |
| 4,037,319 | 7/1977 | Maloof | 29/629 |

*Primary Examiner*—Eugene F. Desmond

*Attorney, Agent, or Firm*—F. Brice Faller

[57] ABSTRACT

A phone plug having axially aligned discrete first and second conductive surfaces thereon which are assembled to conductors without the use of tools comprises a tip member, a dielectric plug body, a tubular sleeve, and a grip. The tip member is inserted into a bore in the plug body to terminate one of the conductors inserted from the opposite end and the sleeve is slid over the plug body to terminate the other conductor. A grip is then slid over the assembly to lock the sleeve in position and provide strain relief for the cable. An alternative embodiment may be terminated to conductors having standard electrical terminals.

14 Claims, 9 Drawing Figures

TOOLLESS PHONE PLUG

BACKGROUND OF THE INVENTION

1. The Field of the Invention

Phone plugs of the type concerned herein have electrically isolated conductive surfaces tandemly situated along a common axis. Of primary concern are two conductor type phone plugs having all points on the conductive surfaces equally spaced from the axis, whereby each contact will make electrical connection with its mating contact regardless of the angular disposition of the coupling part about the axis of engagement.

2. The Prior Art

Prior art phone plugs of this type generally have a conductive center contact pin concentrically situated within a hollow conductive cylinder and isolated from it by dielectric spacers. A common type has a pin in the form of a bolt which threads into a piece which forms the nose of the plug; the nose sits on a dielectric washer which isolates it from the end of the cylinder. The head of the bolt carries contact arms which are isolated from each other by a second dielectric washer; one arm is in electrical contact with the cylinder, the other is in electrical contact with the bolt. The arms are adapted for connection to electrical wires by soldering or screws; a sheath for protection of the arms and plug handling purposes is threaded to the conductive cylinder.

A more recent development is a plug described in U.S. Pat. No. 4,037,319. While structurally more simple than most prior art devices, the assembly requires crimping, soldering, and molding.

The currently used phone plugs, including those described briefly above, are generally satisfactory in performance but involve a large number of parts and complicated manufacturing steps. Further, they all require tools to assemble and are relatively expensive to make.

SUMMARY OF THE PRESENT INVENTION

The instant invention involves an improved phone plug and its method of assembly. An elongated dielectric plug body is molded from a suitable thermoplastic material with a bore extending axially through its length. The plug body has at least one slot cut into each end which allow resilient radial deformation. A tip member has a tapered head which forms the leading conductive surface of the plug and a shank profiled for reception in the bore. The shank has latches which resiliently deform the plug until cooperable recesses in the bore snap over the latches to lock the tip member in place. This also terminates a conductor inserted into the bore from the opposite end by jamming it between the shank and the surface of the bore. A sleeve is then slid over the plug body which terminates a second conductor lying on the surface of the plug body, this conductor having previously been fed into the bore and through a passageway to the surface. A grip is then slid onto the plug body until it mates via a cooperable profile between a hollow in the grip and the surface of the plug body. This also captures the sleeve between a flange on the plug body and a shoulder in the hollow, and provides strain relief for the wires by radially deforming the plug body against the insulation on the wires.

An important object of the present invention is to provide a phone plug which may be assembled without the use of tools.

Another object is to provide a phone plug which involves fewer parts and is less expensive to manufacture.

Means for accomplishing the foregoing and other advantages of the present invention will be apparent from the following detailed description and the accompanying drawings.

BRIEF DESCRIPTION OF THE ACCOMPANYING DRAWINGS

DETAILED DESCRIPTION OF THE PREFERRED EMBODIMENT

Figures 1, 2:
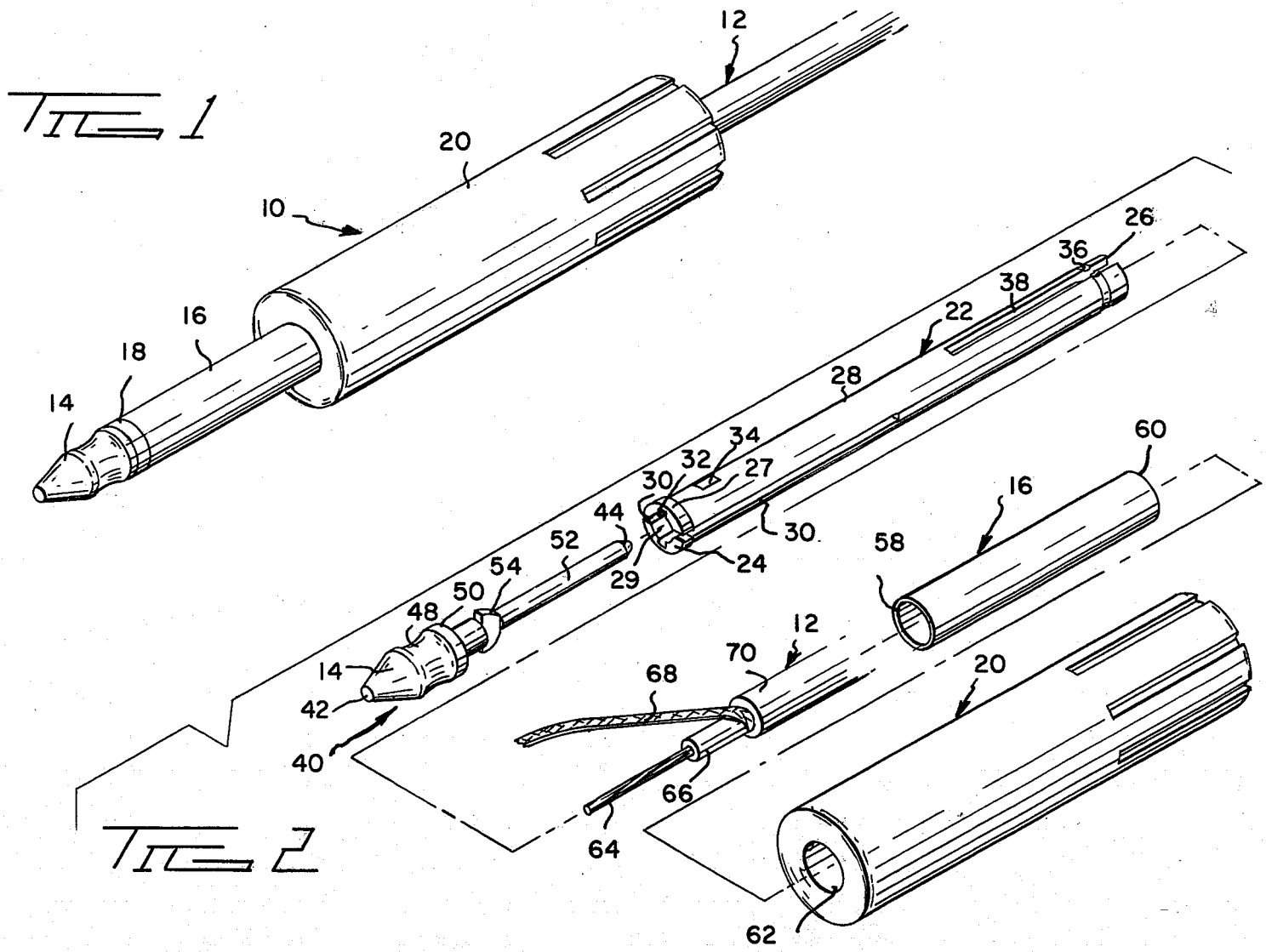
FIG. 1 is a perspective view of the assembled plug as terminated to a coaxial cable.
FIG. 2 is an exploded perspective showing the components of the plug prior to assembly.

A fully assembled phone plug 10 of the preferred embodiment is shown as attached to a coaxial cable 12 in FIG. 1. A tapered head 14 which forms a first conductive surface is separated from a tubular sleeve 16 which forms a second conductive surface by a flange 18 of dielectric material. The tapered head 14 is in contact with the center conductor of the coaxial cable and the tubular sleeve 16 is in contact with the shield conductor of the coaxial cable. A grip 20 facilitates handling of the plug as well as performing assembly functions, as will be explained.

Referring to FIG. 2, the components of the phone plug are shown prior to assembly. A plug body 22 is composed of a resilient dielectric material and has a first end 24 and a second end 26. The body 22 has a flange 27 at the first end 24 and a cylindrical surface 28 lying between the flange 27 and the second end 26. A bore 29 passes through the entire length of the plug. A pair of slots 30 extend inward from the first end 24 and extend past a pair of recesses 34 which pass through the plug body 90° out from the slots 30 on the cylindrical surface 28. The recesses 34 are aligned with ramped lead-in channels 32 notched in the surface of bore 29 at first end 24. A pair of opposed slots 38 extending inward from the second end 44 provide a passageway between the bore 29 and the cylindrical surface 28. An annular groove 36 surrounds the cylindrical surface 28 proximate to the second end 26.

A tip member 40, FIG. 2, is cast in metal and has a first end 42 and second end 44. The tip member 40 has a tapered head 14 at the first end 42, a neck 48 adjacent to the head, and a flange 50 adjacent to the neck. The flange 50 has a diameter equal to the diameter of the flange 27 on the plug body 22. Between the flange 50 and the second end 44 lied a shank 52 profiled for reception in bore 29. Ramped latches 54 lie on the shank 52 spaced from the flange 50 the same distance as recesses 34 are from first end 24 of the plug body 22.

Tubular sleeve 16, FIG. 2, is formed from sheet metal into a stiffly resilient sleeve with an outside diameter equal to that of flanges 27, 50 and an inside diameter substantially equal to but slightly larger than that of the cylindrical surface 28. The grip member 20 has an axial hollow 62 therethrough profiled as will be described later. Coaxial cable 12 is dressed out as shown in FIG. 2. Outer insulation 70 is stripped to expose braided shield 68 which is drawn into a pigtail. A lesser amount of intermediate insulation 66 is stripped to expose the stranded center conductor 64. Note that coaxial cable with a single strand center conductor may also be used.

Figure 3A:
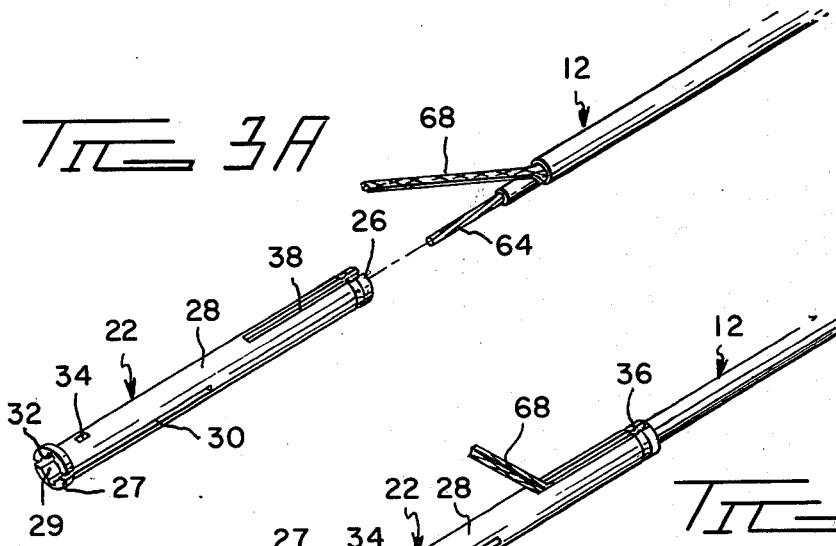
FIGS. 3A-3D are perspectives showing the assembly steps.
Figure 3B:
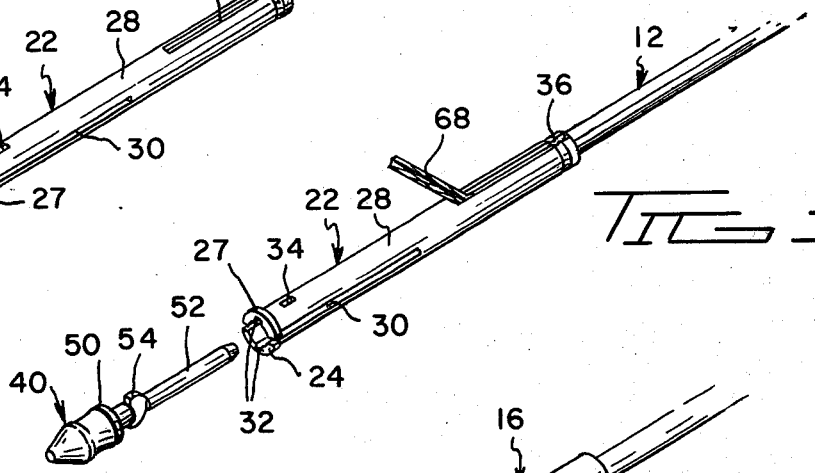
Figure 3C:
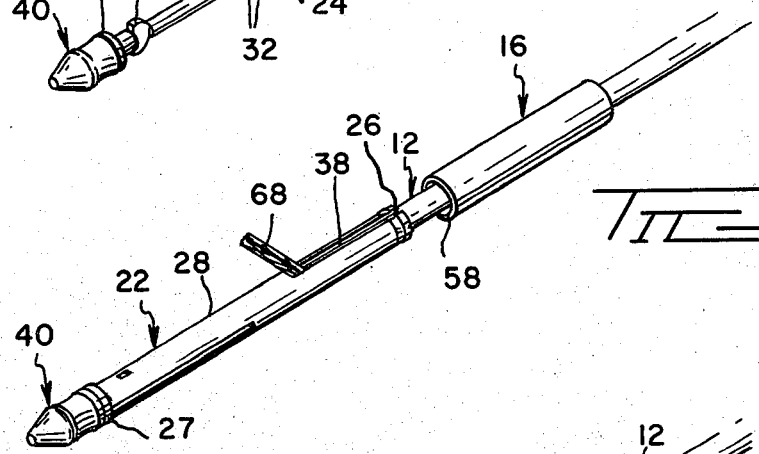
Figure 3D:
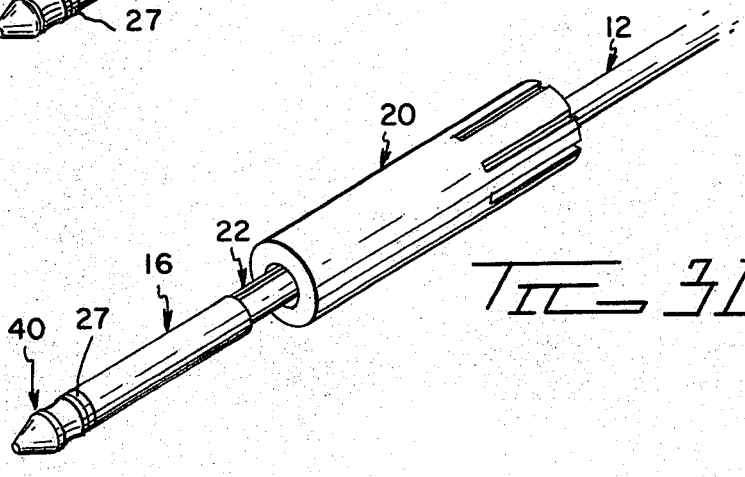

Components heretofore described are assembled as shown in FIGS. 3A through 3D. The dressed coaxial cable 12 is inserted into the bore 29 at the second end 26 of the plug body 22 such that the center conductor 64 lies entirely within the bore and the braided conductor 68 is dragged through either slot 38 so that the exposed portion lies over the cylindrical surface 28 as shown in FIGS. 3A and 3B. The tip member 40 is then inserted into the first end 24 of the plug body 22. The latches 54 enter lead-in channels 32 and the slots 30 allow the body to expand until the flange 50 of the tip member abuts the flange 27 of the plug body. The latches 54 then reach the recesses 34 and the body snaps back into shape. The shank 52 is terminated to the center conductor 64 during this step as will be described later. The mating of the latches and the recesses also precludes relative axial and radial movement between the tip member and the plug body. Referring now to FIG. 3C, the sleeve 16 is inserted over the cylindrical surface 28 from the second end 26 of the plug body 22 as shown in FIG. 3C until the first end 58 of the sleeve abuts the flange 27 of the plug body. This traps the braid 68 between the sleeve 16 and the cylindrical surface 28 which terminates the braid. The interference fit also acts to frictionally retain the sleeve in position. The last step is to slide the grip member 20 over the assembly as shown in FIG. 3D. Thus the entire plug has been assembled without the use of tools, though the cable would at least require the use of a pen knife to dress out the conductors.

Figure 4:
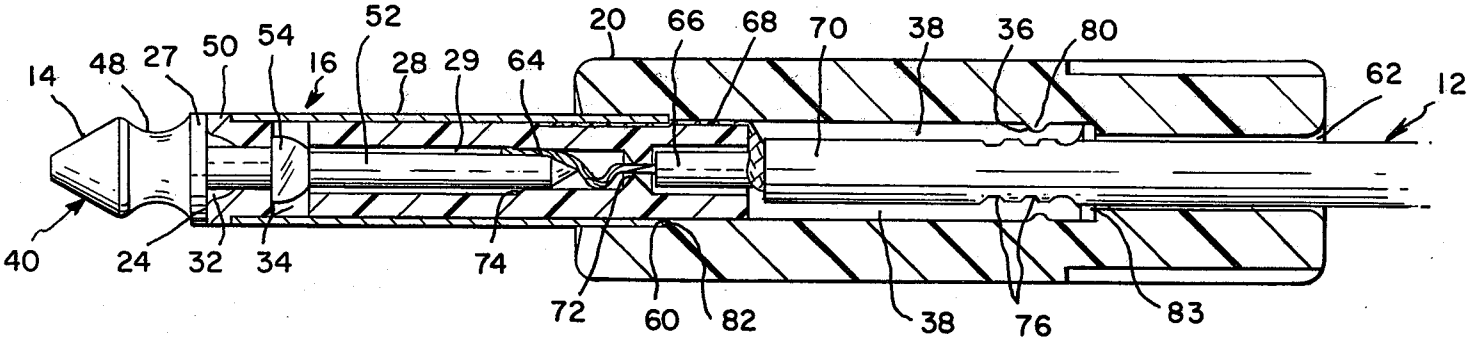
FIG. 4 is a cross section showing the internal details of an assembled plug.

FIG. 4, a cross-sectional view of the assembled plug of the preferred embodiment, shows the details of the cooperation of the components. The latches 54 are captured in the recesses 34 when the flange 27 of the tip member is against the first end 24 of the plug body. The flanges 27, 50 and the tubular sleeve 16 form a continuous cylindrical surface between the neck 48 and the grip member 20. The grip member is maintained in position by a protuberance in the form of an annular rib 80 in the axial hollow 62 which is profiled to fit into the annular groove 36 in the cylindrical surface 28 of the plug body. The slots 38 allow compression of the second end 26 of the plug body as the annular rib 80 is slid into place. The bore 29 in the plug body 22 is profiled with annular ribs 76 which bear against the outer insulation 70 of the cable 12 to provide strain relief. An important feature of the plug body is annular shoulder 82 in the grip member which abuts second end 60 of the tubular sleeve 16. This captures the sleeve between the flange 27 and the shoulder 82 to prevent axial movement of the sleeve. A second annular shoulder 83 in the grip member assures that the grip cannot be jammed too far over the plug body.

The bore 29 of the plug body is profiled with a constricted section or annular strait 72 through which the center conductor 64 passes. The strait prevents the intermediate insulation 66 from passing and thus provides control over the position of the exposed center conductor 64 in the bore. Prior to insertion of the tip member 40, the center conductor 64 lies over an annular shoulder 74 in the bore. The bore between the shoulder 74 and the strait 72 is sized to closely accommodate the shank 52 of the tip member 40, which drags the center conductor 64 up until it becomes wedged against the shoulder 74.

Rotation of the tubular sleeve 16 about the plug body is prevented by friction in the preferred embodiment, though more positive means could be provided, such as a key extending rearwardly from flange 50 into a notch in the first end 58 of the tubular sleeve. Other means include having a barrel seam in the tubular sleeve which would fit into a keyway in the plug body.

Figure 5:
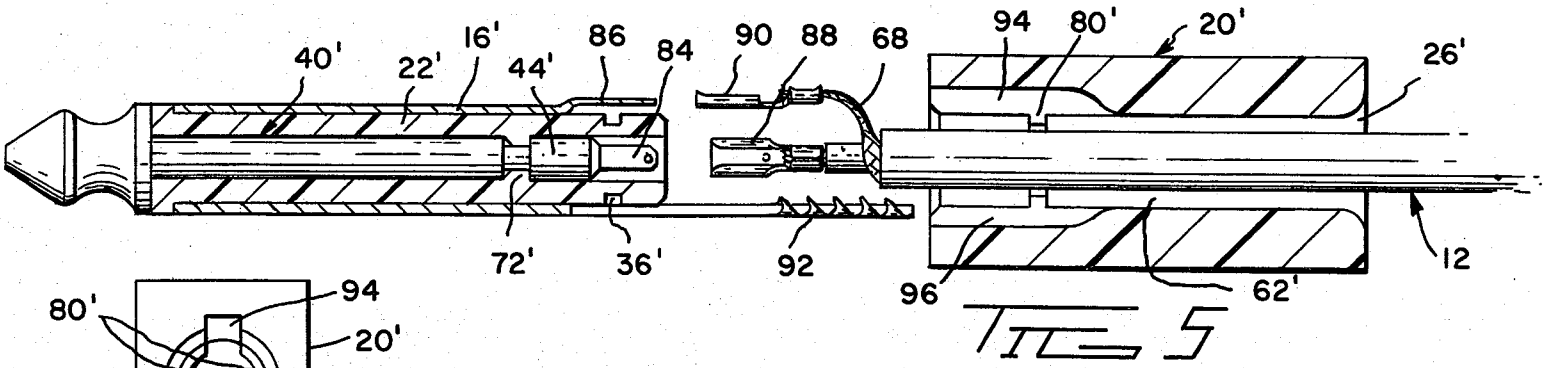
FIG. 5 is a cross section of an alternative embodiment.
Figure 5A:
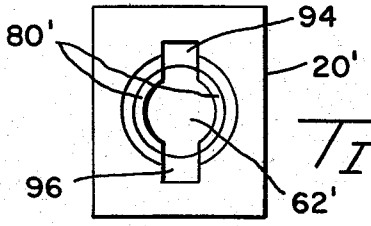
FIG. 5A is an end view of the grip member of the alternative embodiment.

Another embodiment of the invention as assembled is shown cross-sectionally in FIG. 5. This embodiment is directed to a plug which may be mated to standard electrical terminals. Male spade terminals 84, 86 are formed on the second end of tip member 40' and second end of the tubular sleeve 16' respectively. These are mateable with female clip terminals 88, 90 attached to the conductors of a coaxial cable as shown. The plug body 22' is profiled with slots (not visible) cut into the second end 26' which form spring fingers which expand to permit passage of the second end 44' of the tip member 40' through the strait 72', which latches the tip member into the plug body. Strain relief is provided by a spiked member 92 which bears against the outer insulation of the cable when met by a ramped profile in the axial hollow 62'' in the plug handle. An annular groove 36' in the plug body mates with an annular rib 80' in the grip member to provide retention as in the preferred embodiment. The rib is broken at two points by opposed slots 94, 96 in the axial hollow in the grip handle which accommodate the male terminal 86 and the spiked member 92 respectively. The grip 20' for this embodiment is shown cross-sectionally in FIG. 5A. An alternative to toolless assembly using a profiled grip would be to mold the grip member over the preassembled plug.

What is claimed is:

1. A phone plug of the type having axially aligned discrete first and second conductive surfaces thereon, said plug comprising:

a dielectric plug body having a first end, a second end, a cylindrical surface lying between said ends, and a bore extending axially therethrough from said first end to said second end, a conductive tip member having a first end, a second end, and a tapered head at said first end which forms said first conductive surface, a neck adjacent to said head, and a shank lying between said neck and said second end, said shank having a diameter substantially equal to the bore in the dielectric plug body, said shank fitting into said bore with the neck of the tip member proximate to the first end of the plug body, an electrically conductive tubular sleeve which forms said second conductive surface, said sleeve having a first end, a second end, an inside diameter substantially equal to the diameter of the cylindrical surface, and an outside diameter substantially equal to the diameter of said tapered head on said tip member, said sleeve fitting over said cylindrical surface of said plug body with said first end of said sleeve proximate to said first end of said plug body and spaced from said tip member, resilient latching means effective between said tip member and said plug body to retain said shank in said bore, said plug body being composed of resilient material, means for terminating a first conductor to said conductive tip member, means for terminating a second conductor to said conductive tubular sleeve.

2. A phone plug as in claim 1 wherein said plug body has an annular flange thereon at said first end, said flange having a diameter equal to the outside diameter of said tubular sleeve, whereby said flange on said plug body acts to space said first end of said tubular sleeve from said tip member.

3. A phone plug as in claim 1 wherein said tip member has an annular flange thereon between said neck and said shank, whereby said flange abuts said first end of said plug body.

4. A phone plug as in claim 1 wherein said means for terminating a first conductor to a said conductive tip member comprises an interference fit between the shank of the tip member and the bore of the plug body, said first conductor entering said bore of said plug body from the second end thereof;

said means for terminating a second conductor to said conductive tip member comprises an interference fit between said cylindrical surface of said plug body and the inside of the tubular sleeve.

5. A phone plug as in claim 4 wherein said plug body has a passageway between said bore and said cylindrical surface through which said second conductor passes, said second conductor entering said bore of said plug body from the second end thereof.

6. A phone plug as in claim 5 wherein said plug body is composed of resilient material and has at least one slot extending inwardly from said second end thereof, said slot communicating between said bore and said cylindrical surface, said bore being profiled with a protuberance proximate to said second end of said plug body for interference with insulation on said conductors, whereby, said protuberance bears against said insulation to act as strain relief for said conductors.

7. A phone plug as in claim 6 wherein a portion of said cylindrical surface is exposed between said second end of said plug body and said second end of said tubular sleeve, said slot extending only into said portion, said phone plug further comprising an elongated grip member having a hollow extending axially therethrough, said hollow being profiled to fit over said second end of said plug body, whereby said protuberance is forced against insulation on said conductors to provide more positive strain relief.

8. A phone plug as in claim 1 which further comprises an elongated grip member, said grip member having a hollow extending axially therethrough, said hollow being profiled to fit over said second end of said plug body and said second end of said tubular sleeve.

9. A phone plug in claim 8 wherein a portion of said cylindrical surface is exposed between said second end of said plug body and said second end of said tubular sleeve, said hollow in said grip being profiled to mate with said exposed portion of said cylindrical surface, said hollow being further profiled with an annular shoulder which abuts the second end of the tubular sleeve, whereby relative axial movement of the sleeve, the plug body and the grip is prevented.

10. A phone plug as in claim 1 wherein said means for terminating a first conductor to said conductive tip member comprises a terminal on said second end of said tip member mateable to a terminal affixed to said first conductor said means for terminating a second conductor to said conductive tubular sleeve comprises a terminal on said second end of said sleeve mateable to a terminal affixed to said second conductor.

11. A phone plug as in claim 1 wherein said latching means comprises a slot extending inwardly from said first end of said plug body, said slot communicating between said bore and said cylindrical surface, said bore being profiled with a recess spaced a distance from said first end, said distance being less than the length of said slot, said tip member having a flange between said neck and said shank, said shank of said tip member having a latch thereon spaced a like distance from said flange, whereby said latch is mated to the recess in the bore and relative radial and axial movement between the tip member and the plug body is prevented.

12. A method of assembling a phone plug having axially aligned discrete first and second conductive surfaces without the use of tools comprises the steps of:

feeding a stripped end of a first insulated conductor into a bore in a dielectric plug body, said bore extending through said plug body from a first end to a second end, said first conductor being fed into said second end, feeding a stripped end of a second insulated conductor into said bore in said second end and through a passageway between said bore and a cylindrical surface lying between said ends of said plug body so that said stripped end lies over said cylindrical surface, feeding a conductive tip member into said bore from said first end of said plug body until a flange on said tip member abuts said first end of said plug and said stripped end of said first conductor is interference fit between said tip member and said bore, said tip member having a shank portion profiled for a close fit in said bore and a head adjacent said flange which forms said first conductive surface, sliding an electrically conductive tubular sleeve over said cylindrical surface from said second end of said plug body until said sleeve is proximate to but spaced from said flange of said tip member and said stripped end of said second conductor is interference fit between said plug body and said sleeve, said sleeve forming said second conductive surface.

13. A method of assembling a phone plug as in claim 12 which comprises the additional step of sliding a grip member over said second end of said plug body, said grip member having a hollow therethrough, said hollow being profiled to closely accommodate said second end of said plug body and said second end of said tubular sleeve.

14. A method of assembling a phone plug as in claim 12 wherein said first conductor is the center conductor of a coaxial cable and said second conductor is the braided conductor of the coaxial cable, whereby the steps of feeding the stripped end of the first conductor into the bore and feeding the stripped end of the second conductor into the bore and over the cylindrical surface are performed simultaneously.

* * * * *